US005502897A

United States Patent [19]

Rauch

[11] Patent Number: 5,502,897

[45] Date of Patent: Apr. 2, 1996

[54] SCISSORS

[75] Inventor: Joseph A. Rauch, Tivon, Israel

[73] Assignee: R.I.D. Rauch Industrial Design Ltd., Tivon, Israel

[21] Appl. No.: 252,599

[22] Filed: Jun. 1, 1994

[51] Int. Cl.[6] ..... B26B 13/00; B26B 13/26

[52] U.S. Cl. ..... 30/251; 30/233; 30/257

[58] Field of Search ..... 30/250, 251, 254, 30/233, 257, 238, 260, 252

[56] References Cited

U.S. PATENT DOCUMENTS 674,828 5/1901 Farnham ..... 30/233
1,174,175 3/1916 Moster ..... 30/233
2,520,905 9/1950 Borrelli ..... 30/251 X
2,560,673 7/1951 Vosen et al. ..... 30/257
3,375,581 4/1968 Knight ..... 30/238
4,094,064 6/1978 Nishikawa et al. ..... 30/251

*Primary Examiner*—Douglas D. Watts
*Attorney, Agent, or Firm*—Kane, Dalsimer, Sullivan, Kurucz, Levy, Eisele & Richard

[57] ABSTRACT

Improved scissors comprise a cutting assembly and a grip assembly, and a kinematic connection between said two assemblies, whereby said blade assembly is actuated for cutting action by applying pressure to said grip assembly.

4 Claims, 17 Drawing Sheets

(a)

(b)

(c)

SCISSORS

FIELD OF THE INVENTION

This invention relates to improved scissors, particularly ergonomic scissors having improved grip, adjustable shearing force, interchangeable blade types and safety of operation, as well as an attractive appearance.

BACKGROUND OF THE INVENTION

Scissors are among the most widely used tools, but in spite of the great number of variants known in the art, most existing scissors lack operational efficiency. Conventional scissors are not completely safe, nor do they guarantee accurate cutting. Furthermore, they sometimes require undesirable effort, their prolonged use may cause blisters, and they do not provide a fully satisfactory grip. In some prior art scissors, sculptured handles have been provided; however, these create problems for left-handed people and for people having an irregularly sized grip. Conventional scissors, furthermore, are not adjustable to fit different grips and materials.

It is a purpose of this invention to eliminate all the aforesaid defects of prior art scissors.

It is another purpose to provide scissors which have a completely satisfactory grip to fit a wide user population, including children, aged persons, and some disabled persons as well.

It is a further purpose to provide scissors that are absolutely safe and eliminate blisters and pinching hazards.

It is a still further purpose to provide scissors which have an adjustable shearing leverage to fit different grips and/or materials.

It is a still further purpose to provide scissors which permit to hold the entire hand of the user above the material and spaced from it.

It is a still further purpose to provide scissors in which the cutting blades may be easily replaced and which may be provided with different sets of blades for different purposes and/or materials.

It is a still further purpose to provide scissors which have a particularly attractive appearance.

Additional purposes and advantages of the invention will appear as the description proceeds.

SUMMARY OF THE INVENTION

The scissors according to the invention are characterized in that they comprise a cutting assembly and a grip assembly, and an operative connection, preferably a lever connection, between said two assemblies, whereby said blade assembly is actuated for cutting action by applying pressure to said grip assembly. Said operative connection is such that displacements in the grip assembly cause corresponding displacements in the blade assembly. It is, therefore, a kinematic connection, and it will be designated as such hereinafter.

In a preferred form of the invention, said operative or kinematic connection comprises a rocker lever having a displaceable fulcrum, whereby to adjust the shearing leverage, or in other words, the ratio between the pressure exerted on the grip assembly and the cutting force developed between the blades of the blade assembly.

In a further preferred form of the invention, the blade assembly is detachable from the grip assembly, and the same grip assembly maybe provided with interchangeable blade assemblies. Preferably, a cover, more preferably a flexible cover, is provided between the blade assembly and the grip assembly, to cover any gap therebetween.

In a further preferred form of the invention, the scissors have essentially an inverted-Z configuration, comprising two arms and a bridge connection therebetween, the grip assembly defining one arm and the blade assembly the other, and the bridge enclosing the kinematic connection between the two assemblies, whereby when the blade assembly operates to cut a material, the grip assembly is spaced from said material. The definition "inverted-Z configuration" is referred to the scissors as seen when gripped by a right-handed person. A left-handed person would see a Z configuration.

In a further preferred form of the invention, the grip assembly comprises two mutually pivoted members or jaws, that can be rotated with respect to one another, and specifically brought closer together, by a pressure exerted on them by the user's hand. Preferably, a flexible cover is provided between the two jaws of the grip assembly, whereby to permit relative rotation thereof, while closing the grip assembly to the outside. Also preferably two soft pads are provided on the outside of the grip jaws for increased operation comfort.

In a further preferred embodiment of the invention, the shearing leverage is adjusted by displacing the fulcrum of the rocker lever connection between the grip assembly and the blade assembly.

Preferably, elastic means are provided for constantly urging the scissors to its inoperative, open position, wherein the members of the grip assembly are spaced from one another and the blades of the blade assembly are spaced from one another as far as their structure will permit.

In a preferred embodiment of the invention, both the grip assembly and the blade assembly comprise a base member and a complementary member, the complementary members being pivoted on the base members and being operatively connected to one another, preferably by rocker lever means. The base member of the blade assembly is sometimes called hereinafter "base blade" and its complementary member, "movable blade". When the blades are rectilinear, the center of their relative rotation, viz. the pivot about which the two blades rotate relative to one another, is positioned not at or about the intersection of the two straight lines defined by the cutting edges of the two blades, as in conventional scissors, but at a distance from said lines. This position will be briefly called "offset position". When the blades are curved, but the projections of their cutting edges on a plane perpendicular to the axis of their relative rotation are straight, the above definition of the "offset position" should be referred to said projections. When the blades are curved and the projections of their cutting edges on an plane perpendicular to the axis of their relative rotation are not straight, the above definition of the "offset position" should be referred to the tangents to said cutting edges at the points where said edges are closest together. The expression "offset position", whenever used in the specification and claims, should be understood as including all the aforesaid alternatives. The advantages of the offset position will be explained hereinafter.

The base member of the grip assembly is sometimes called hereinafter "base jaw" and its complementary member, "pressure jaw". The blade assembly and the grip assembly are connected, when the scissors is assembled, by connecting the respective base members; and the scissors is activated for cutting by causing the grip pressure member to rotate towards the grip base member, whereby the movable blade is rotated complementary members.

In the above description of the drawings, the terms "vertical", "plane", "side" and "front" refer to the position of the scissors when cutting a horizontal, sheet material, viz. the position in which the cutting motion of the cutting blade is vertical.

DETAILED DESCRIPTION OF PREFERRED EMBODIMENTS

In the embodiment illustrated, the scissors comprise a grip assembly 10 and a blade assembly 11, which are preferably, though not necessarily, removably connected with one another, as will be explained hereinafter.

Figure 9:
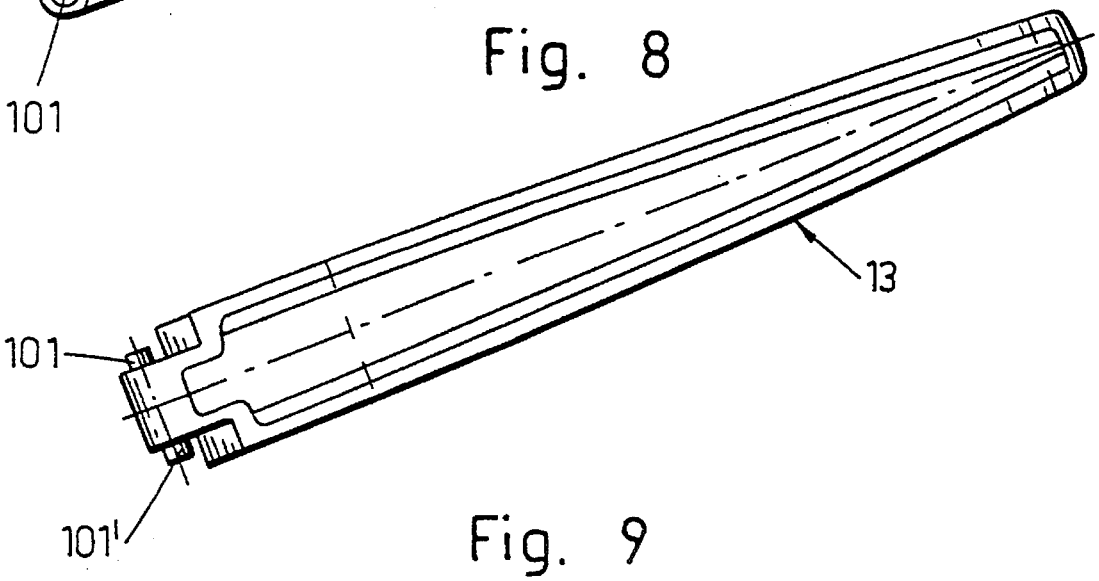
FIG. 9 is a plan view of the same, seen from the top.
Figure 21:
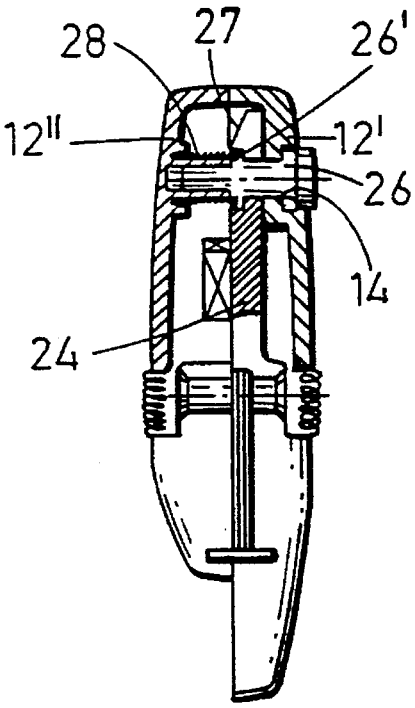
FIG. 21 is a partial cross-section of the scissors taken on the broken line XXI—XXI.
Figure 20:
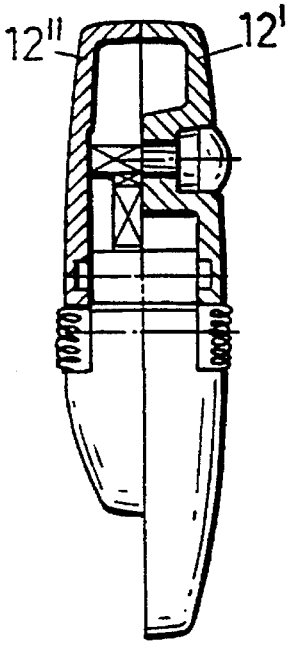
FIG. 20 is a cross-section of the scissors taken on the broken line XX—XX of FIG. 3.
Figure 19:
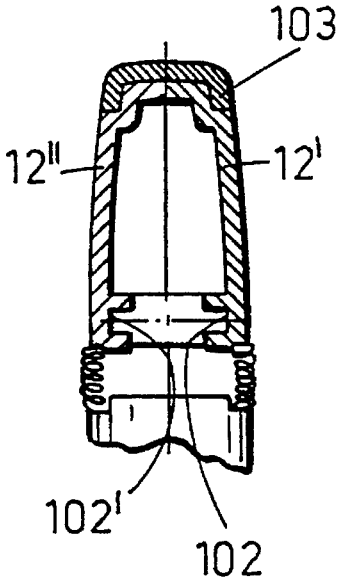
FIG. 19 is a cross-section of the scissors taken on the broken line XIX—XIX of FIG. 3, with its lower portion broken off.

The grip assembly 10 comprises a base member or base jaw 12 and a complementary member or pressure jaw 13. The base jaw is preferably made of two parts—right and left, 12' and 12"—as best seen in FIGS. 19 to 21, which are connected in any convenient way, not illustrated in the drawings, but preferably have a snap fit into one another. The two members or jaws are pivotally connected in any convenient way. In the example illustrated, the pressure jaw, as seen in FIG. 9, comprises, at its end, two circular pins 101—101'. The base jaw has two corresponding seats 102—102' (see FIG. 19). In order to connect the two jaws together, said pins 101—101' are inserted into said seats 102—102'. A flexible cover, in the embodiment described, a bellows-like cover 15 (see FIGS. 1 to 4), is disposed between the two in order to cover the space therebetween. Soft pads 106 and 107 are preferably provided at the top of the base jaw and at the bottom of the pressure jaw, respectively.

Figure 11:
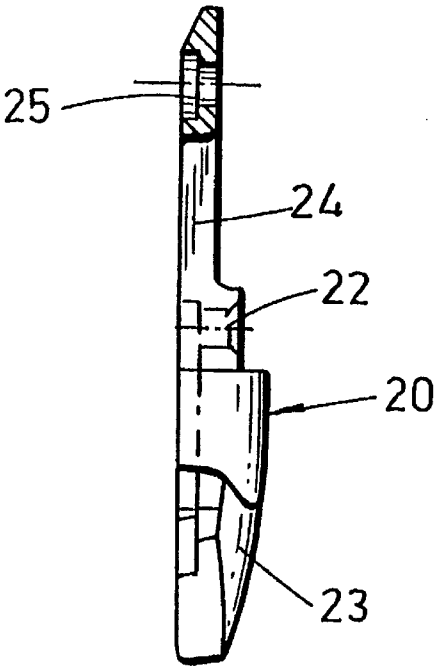
FIG. 11 is a vertical, front view, partly in cross-section, of said base blade.
Figure 10:
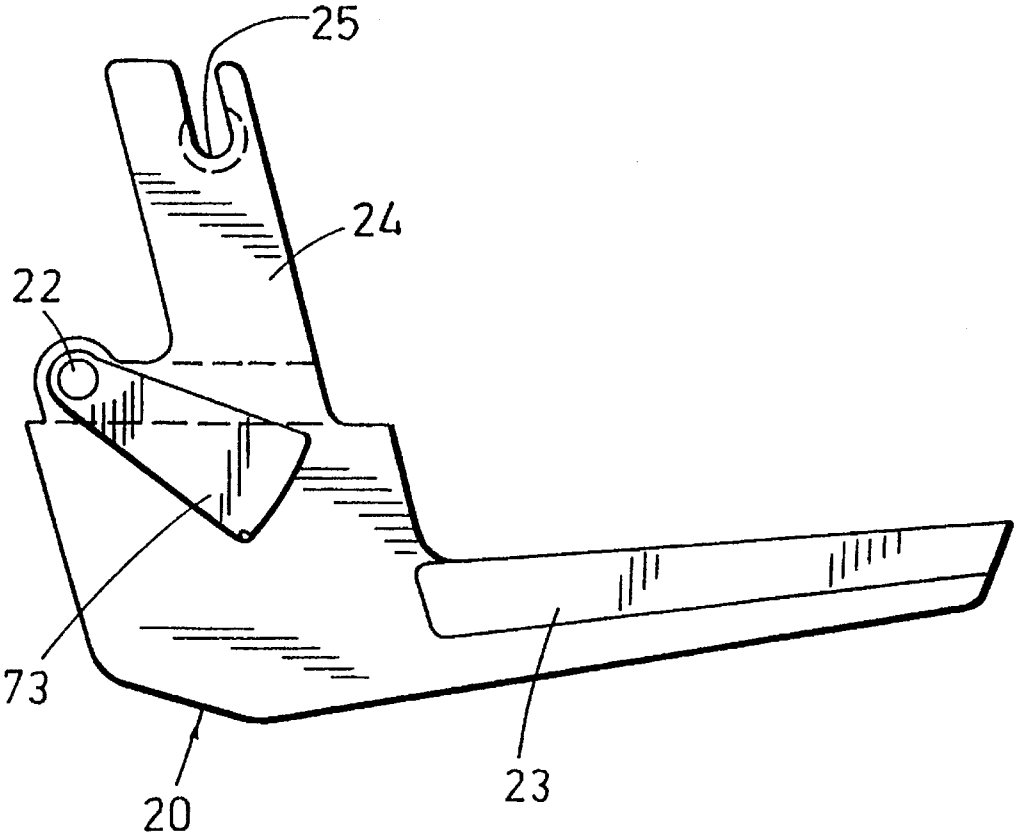
FIG. 10 is a vertical, side view of the base blade, seen from the inside.

The blade assembly 11 comprises a base blade 20 and a movable blade 21, pivoted to the base blade at 22. The base blade (FIGS. 10 and 11) comprises a cutting portion or blade proper 23 and a bracket 24 extending at approximately right angles to blade proper 23. Bracket 24 has at its upper end a seat or recess 25 for housing a snap-in connecting and releasing pin 26 which is seated in an aperture 14 of base jaw 12. As seen in FIG. 21, a spring 28, bearing against a sleeve 26' of pin 26, constantly urges said pin towards said bracket 24. When the blade assembly is to be connected to the grip assembly, bracket 24 is inserted into the grip assembly and is shifted upwards. As a result of this motion, the slanted upper edge 27 of said bracket engages sleeve 26' and displaces pin 26 to the left (as seen in FIG. 21) thereby compressing spring 28. When bracket 24 has reached the assembled position, shown in FIG. 21, spring 28 causes sleeve 26' to snap into seat 25, thereby connecting grip assembly and blade assembly together. To separate the two assemblies, in order to disassemble the scissors to change the blade assembly or for any other purpose, it suffices to press on the head of pin 26, thereby compressing spring 28, until sleeve 26' has shifted leftwards, as seen in FIG. 21, to the outside of seat 25, whereafter bracket 24 may slide downwards past pin 26 and the two assemblies are disconnected.

Figure 1:
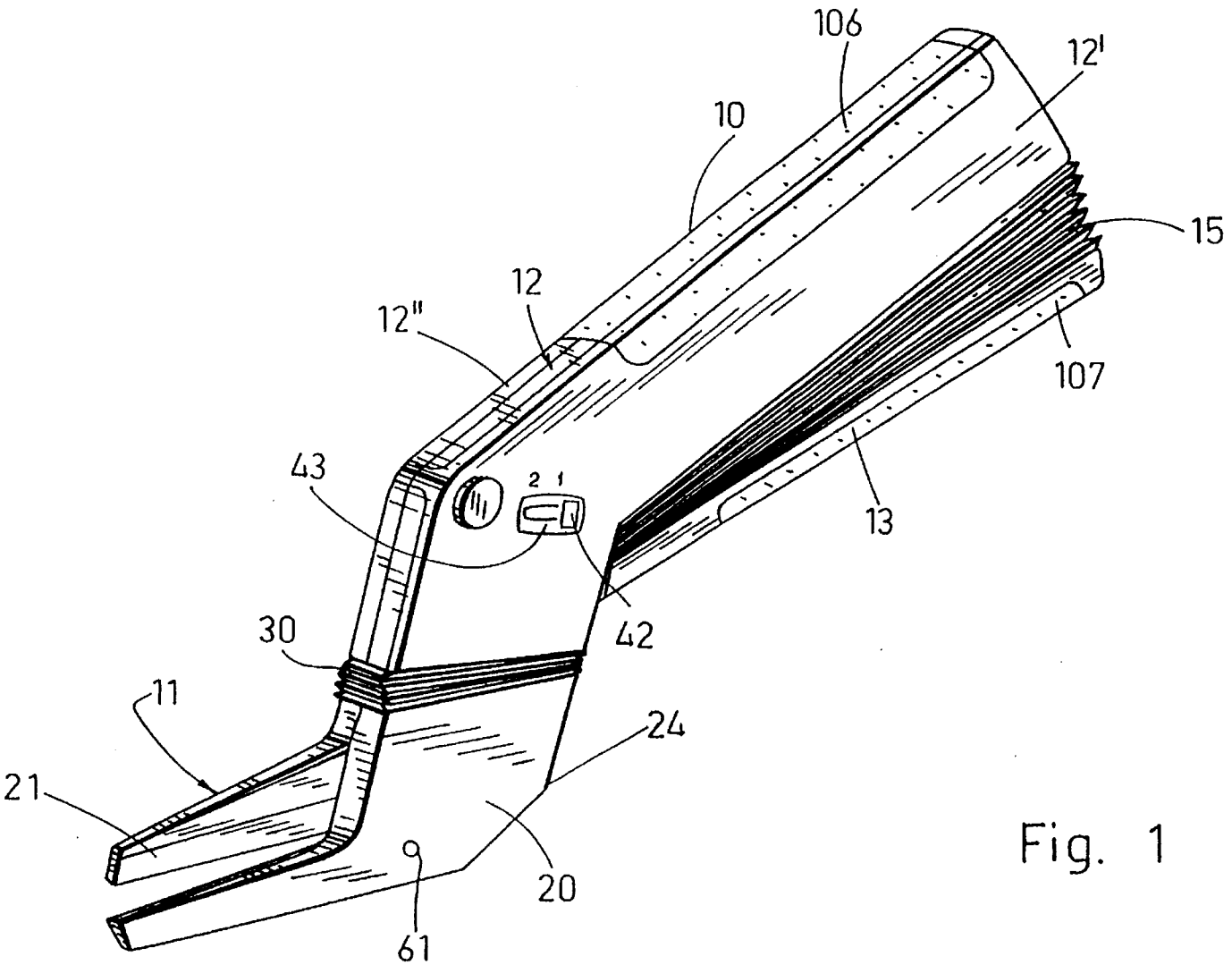
FIG. 1 is a perspective view of a scissors according to an embodiment of the invention, with the blades in the open position.
Figure 2:
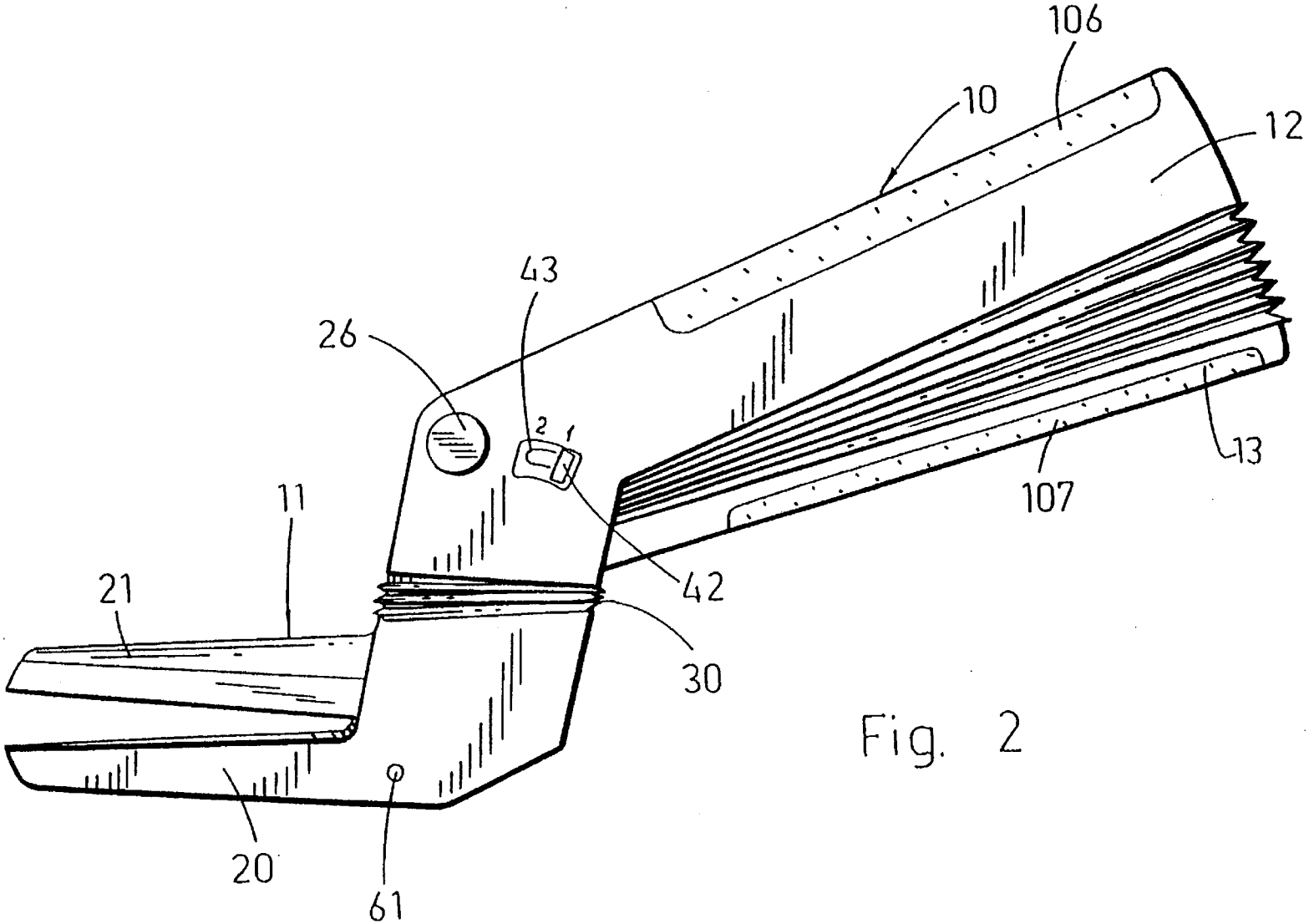
FIG. 2 is a vertical, side view of the same.

A flexible cover 30, bellows-like in the embodiment described, cover the gap between grip assembly 12 and blade assembly 10 (see FIGS. 1 and 2). Instead of said flexible cover, other, e.g. rigid, means could be provided to cover said gap, or one could dispense from cover means altogether; and the same is true of the previously described cover 15.

Figure 12:
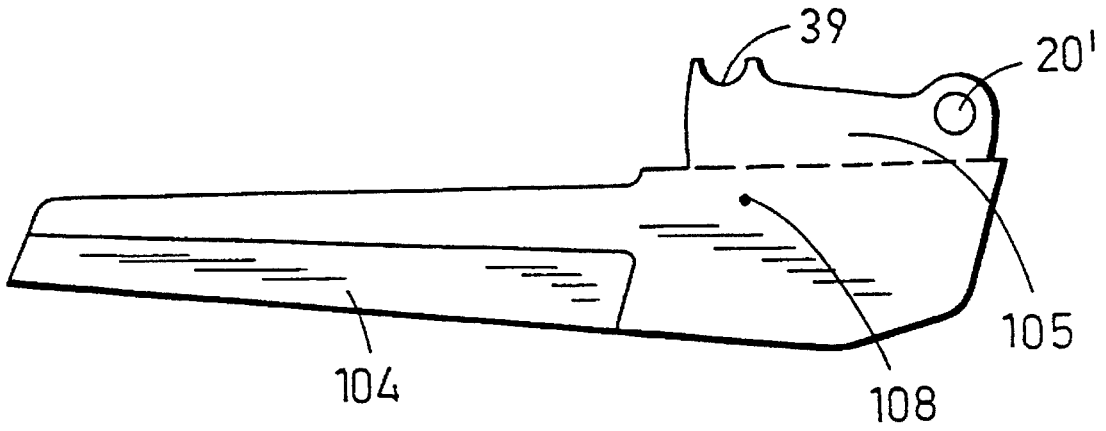
FIG. 12 is a vertical, side view of the movable blade, seen from the outside.
Figure 13:
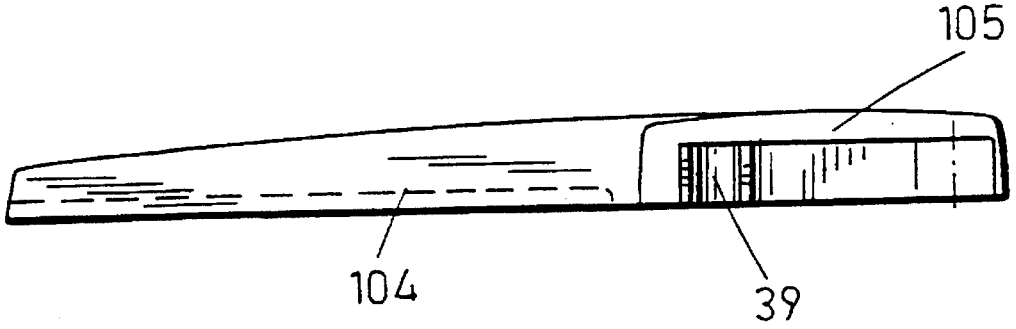
FIG. 13 is a plan view of the same, seen from the top.
Figure 15:
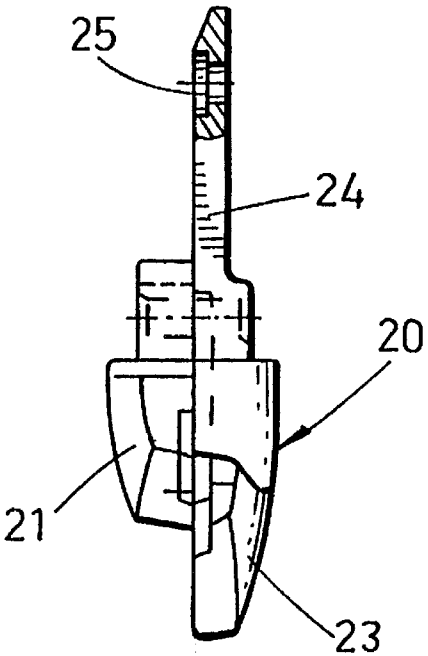
FIG. 15 is a vertical, front view of the same.
Figure 14:
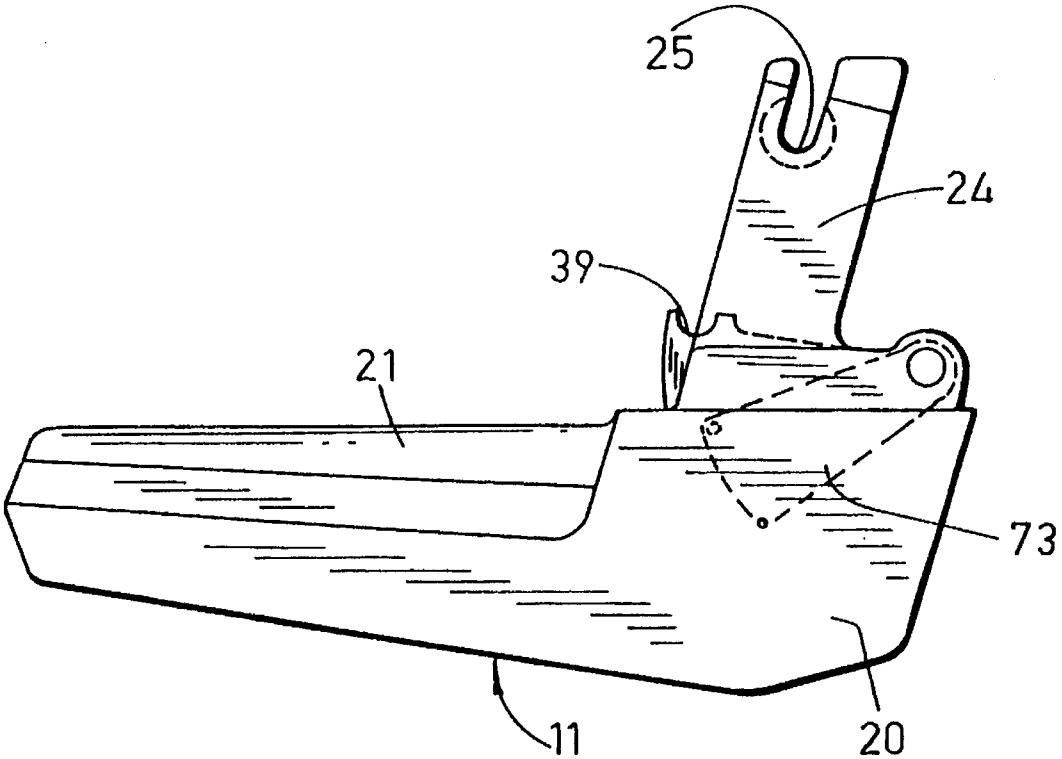
FIG. 14 is a vertical, side view of the blade assembly.
Figure 25:
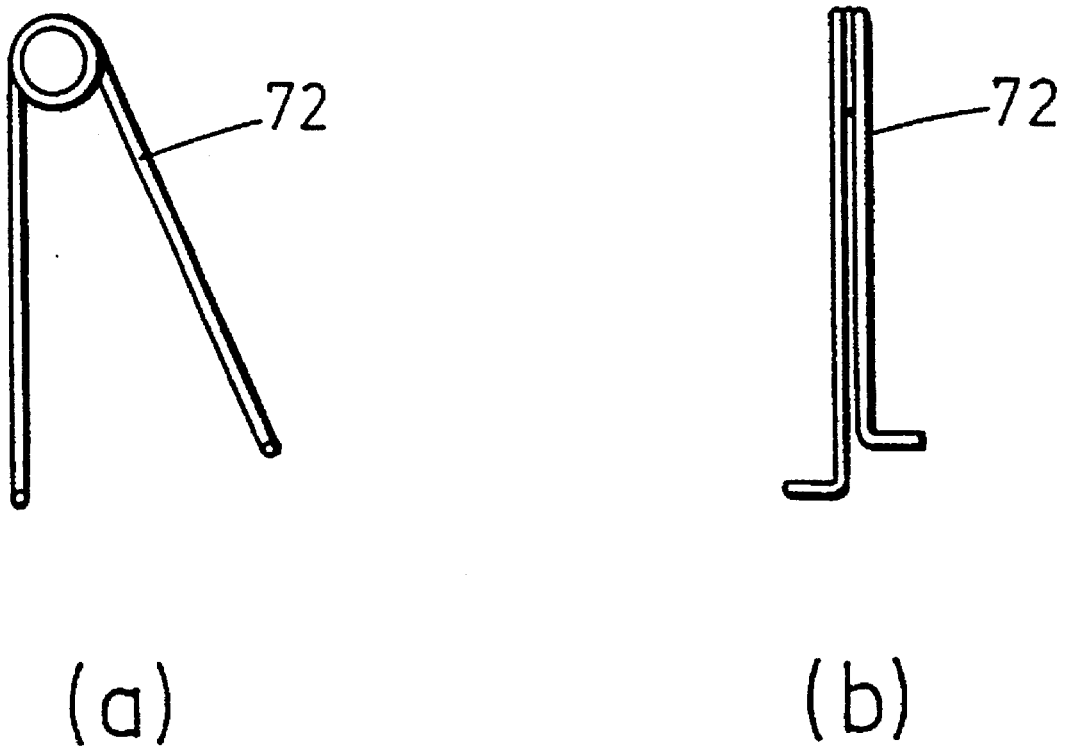
FIGS. 25(*a*) and (*b*) illustrate a return spring.

The movable blade 21 (FIGS. 12–13) comprises a blade proper 104 and a base 105, in which a seat 20' for pivot connection 20 is provided. Base 105 further comprises an open seat 39 for receiving the follower 38, hereinafter described. An elastic reaction element or return spring 72, shown in FIGS. 25(*a*) and (*b*) in side and front view respectively, is housed in a seat 73 of the base blade, engages wiuth one end a bore 108 of the movable blade (see FIG. 12) and continually urges this latter to its inoperative, open position, viz. to the position in which it is spaced as much as possible from the base blade.

In conventional scissors, the two blades rotate about a pivot that is located at or about the intersection of the two straight lines on which the cutting edges of the blades lie. As a result, the force exerted on the material to be cut has a substantial component that tends to shift the material along the blades to the outside of the cutting space between them. On the contrary, according to the invention, as seen in the drawings, the pivot 22 about which the two blades rotate with respect to one another, is not located at or about said intersection, but is distanced from it, in an offset position. As a result, the shearing action carried out by the blades is more similar to that of a guillotine device and the force urging the material away from the cutting space is minimized, thereby considerably improving the cutting process and the human interface.

Figure 3:
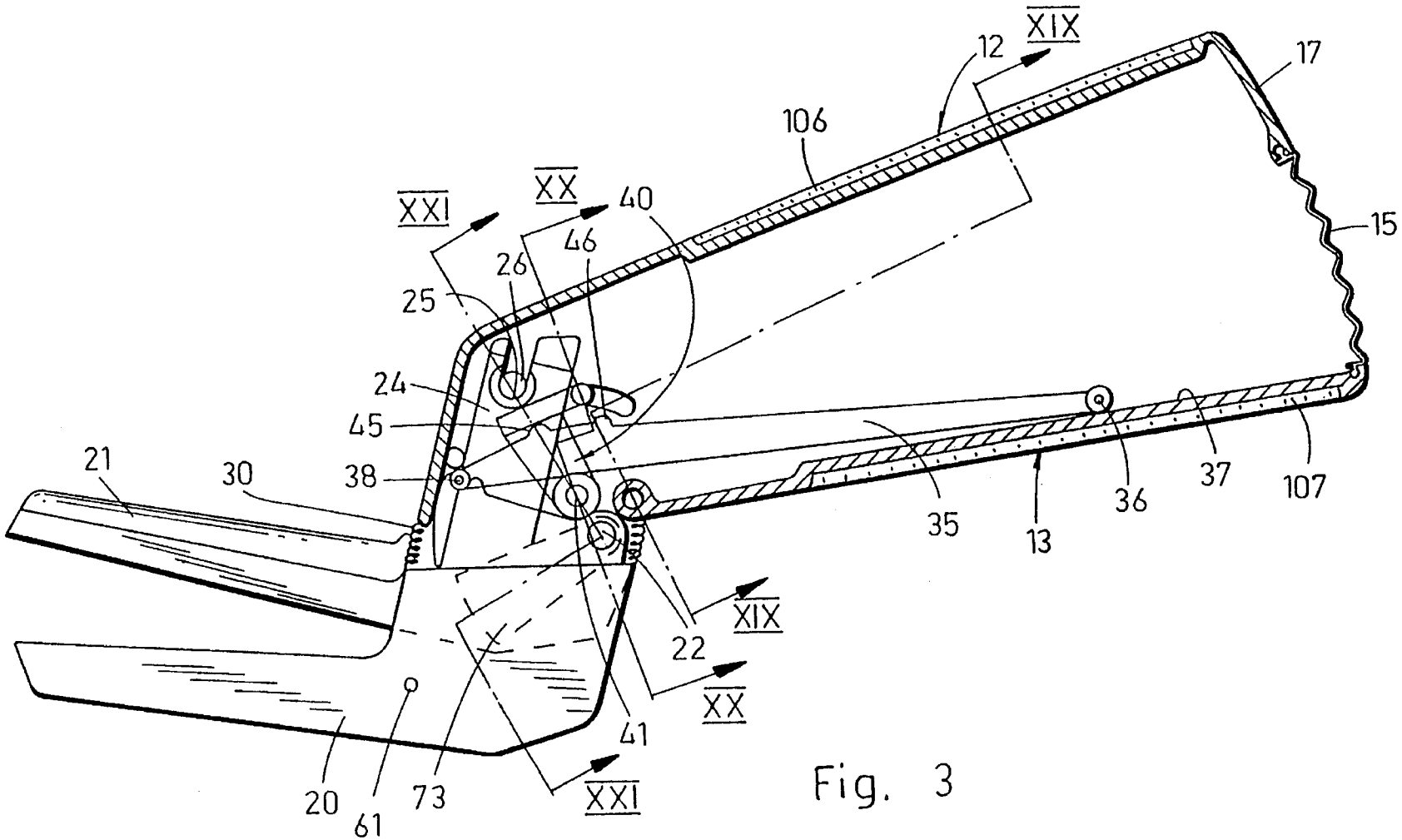
FIG. 3 is a view similar to FIG. 2, with part of the grip assembly (as hereinafter defined) removed to show the inner mechanism.
Figure 4:
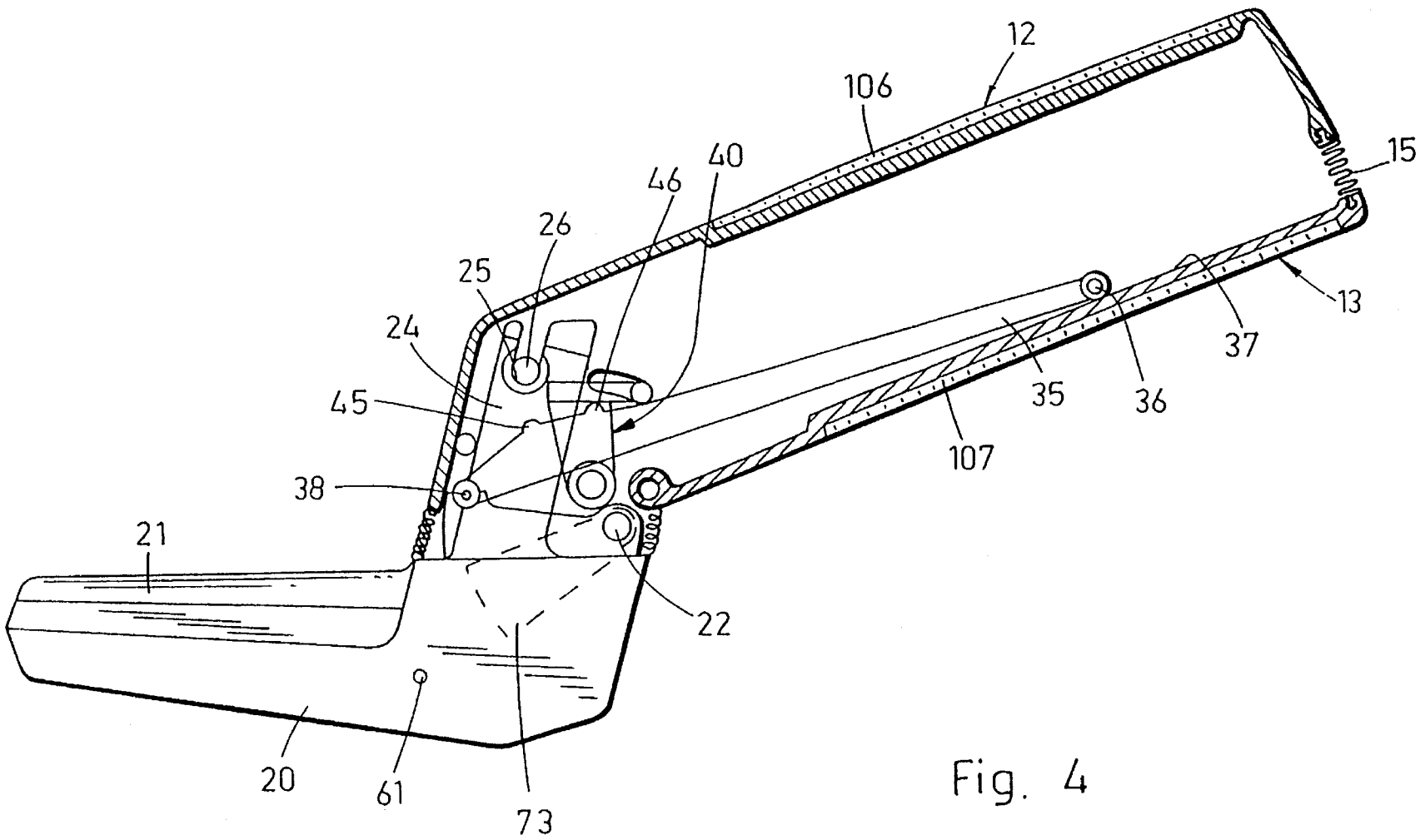
FIG. 4 is a view similar to FIG. 3, but with the blades in the closed position and the power selector lever (as hereinafter defined) in a position alternative to that of FIG. 3.
Figure 5:
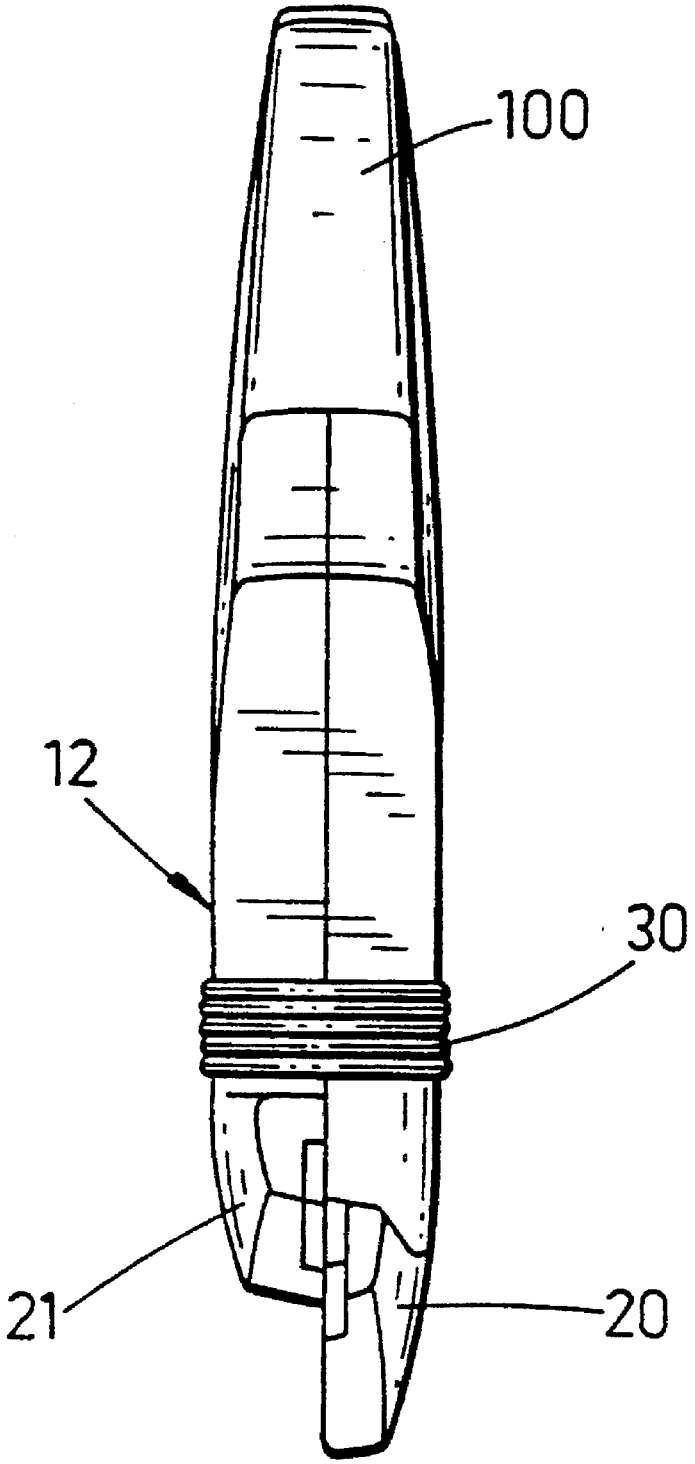
FIG. 5 is a vertical, front view of the scissors of FIG. 2.
Figure 6:
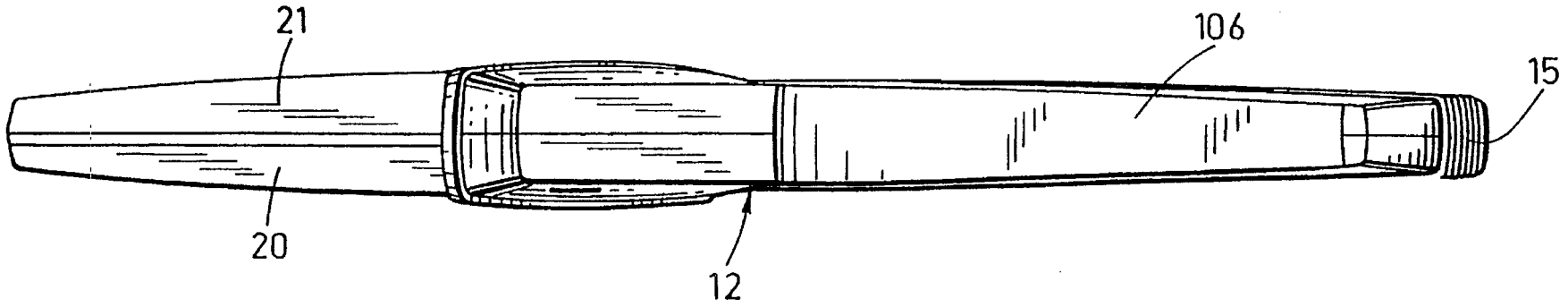
FIG. 6 is a top view of the scissors of FIG. 2.
Figure 7:
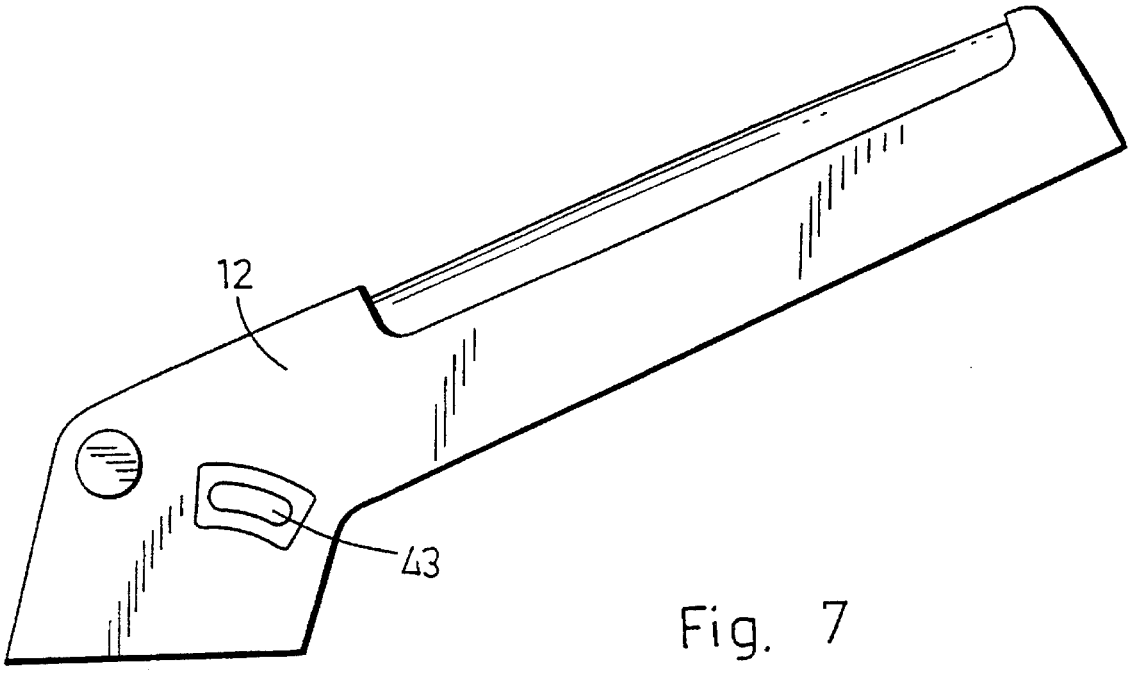
FIG. 7 is a vertical, side view of the base jaw of the grip assembly of the scissors of the preceding figures.
Figure 8:
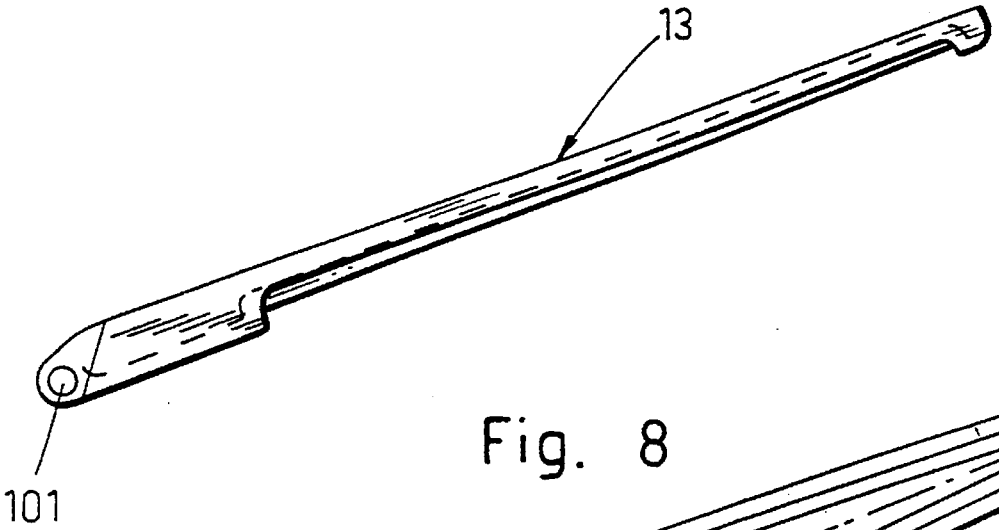
FIG. 8 is a vertical, side view of the pressure jaw of the grip assembly.
Figure 16:
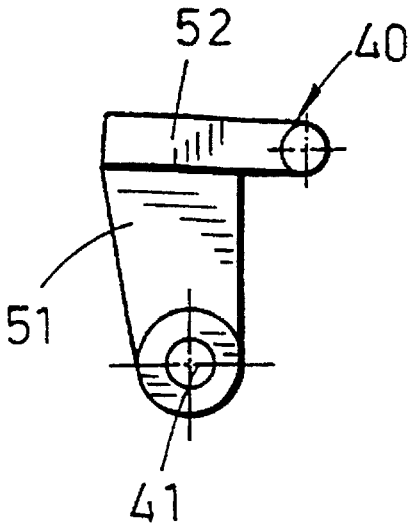
FIGS. 16(*a*), (*b*) and (*c*) are respectively vertical, front and side, and plan view of the power selector lever.
Figure 16:
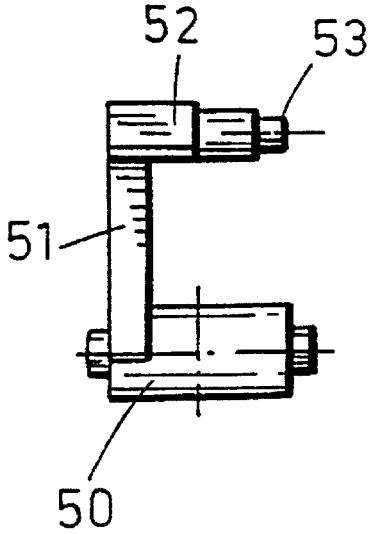
Figure 16:
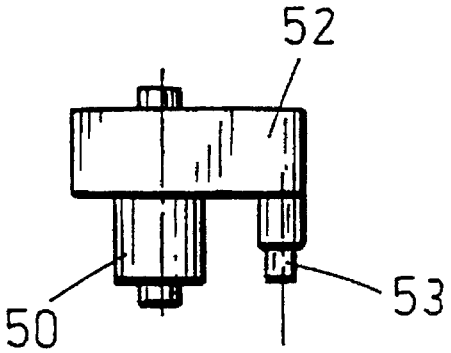
Figure 17:
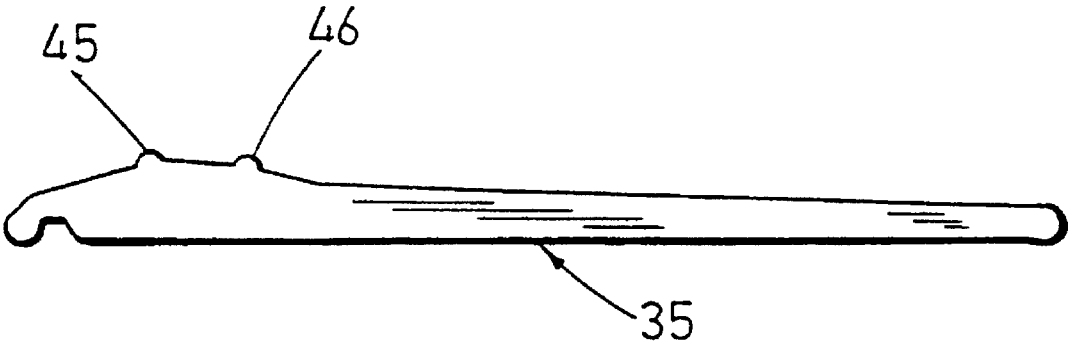
FIG. 17 is a vertical, side view of the rocker lever.
Figure 18:
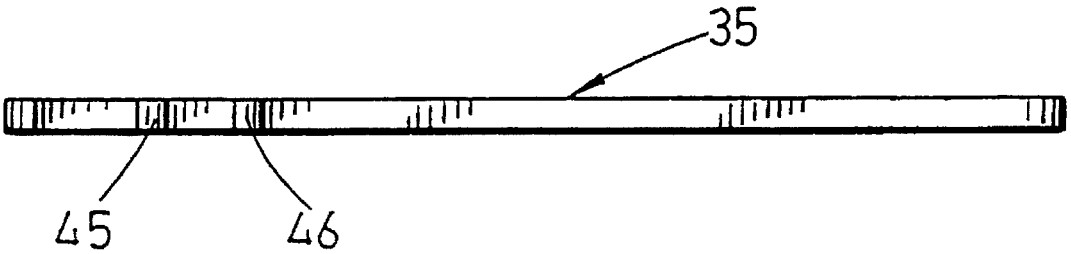
FIG. 18 is a plan view of the same.

The operative or kinematic connection between the grip assembly and the blade assembly is provided by a rocker lever 35 (FIGS. 17 and 18). Said lever is provided with a follower 36 (see FIGS. 3 and 4) which bears on a surface 37 of pressure jaw 13 of the grip assembly and with a follower 38 which bears on said seat 39 of the movable blade 21. An essentially C-shaped power selector lever 40 (FIGS. 16,(*a*), (*b*), (*c*)) is pivoted at 41 to the base jaw 12. It comprises a lower arm 50, a web 51 and an upper arm 52. The upper arm 52 ends with a pin portion 53 on which is mounted a knob 42 (not shown in FIG. 16—see FIGS. 1 and 2), which passes through a slit 43 in the said base jaw 12. Said upper arm 52 bears on one of two projections 45–46 of rocker lever 36. By acting on said knob, power selector lever 40 can be shifted from the position shown in FIG. 3, in which it bears on projection 45, to the position shown in FIG. 4, in which is bears on projection 46, and vice versa. When the pressure jaw is rotated towards the base jaw, it urges follower 36 upwards (as seen in the drawings) and said rocker lever presses with one of projections 45–46 on portion 52 of power selector lever 40, and the projection, that so presses against the power selector lever, acts as fulcrum in the rotation of rocker lever 35. The rocker lever, then, rotates counterclockwise as seen in FIGS. 3 and 4. As a consequence, follower 38 is displaced downwards as seen in said figures, and, by acting on seat 39, causes the movable blade 21 to rotate in the same direction as rocker lever 35 and to be displaced from its inoperative or open position to a closed position abutting the base blade 23, thereby producing a cutting action. The force exerted by the user on pressure jaw 13 and, through follower 36, on rocker lever 35, creates a moment about fulcrum 45 or 46, and therefore a pressure on seat 39. The resulting reaction of seat 39 on follower 38 is such that its moment about pivot 45 or 46 is equal to moment of the pressure exerted by follower 36 on rocker lever 35. Therefore, the ratio of the force exerted by the user to the force which is transmitted from follower 38 to movable blade 21 depends on the ratio between the distances of said fulcrum from followers 36 and 38 respectively. By displacing power selector knob 42 along slit 43, and thereby selecting projection 45 or 46 as fulcrum of the rocker lever 35, the ratio of the forces is changed and a smaller or greater cutting force can be produced by the same pressure on the grip assembly, as desired. In the position of the power selector shown in FIG. 3 the moment exerted by a given force applied to the grip jaw is greater than in the position shown in FIG. 4. When the movable blade is urged to its inoperative position by the action of spring 72, seat 39 exerts a pressure on follower 38 and causes rocker lever 35 to rotate clockwise, as seen in FIGS. 3 and 4, thereby returning the pressure jaw 13 to its inoperative, open position, in which it is spaced as much as possible from the base jaw 12.

Figure 22:
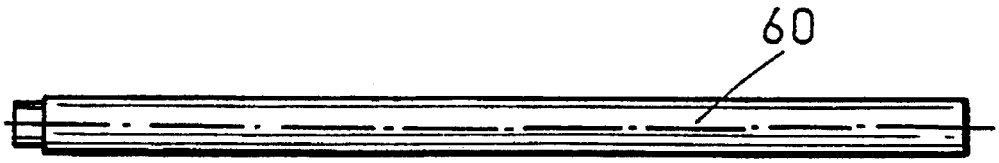
FIG. 22 is a view of an accessory support.
Figure 23:
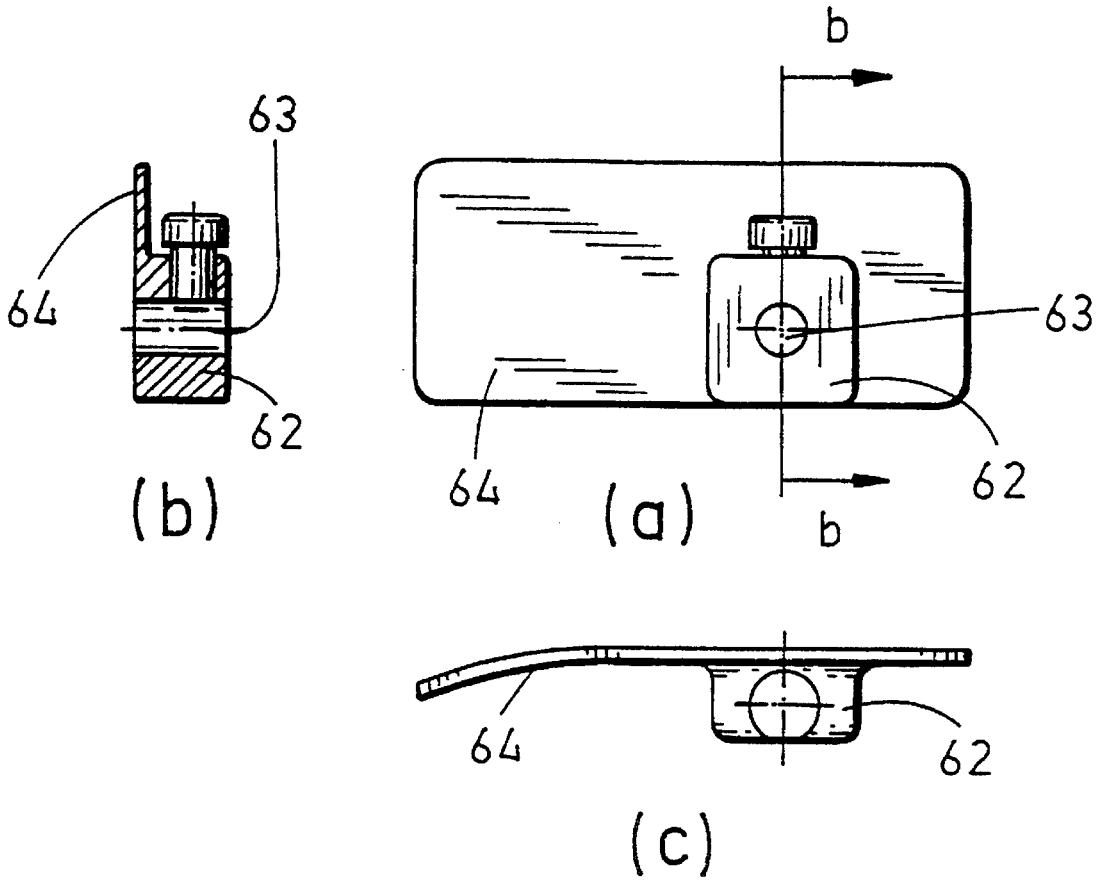
FIGS. 23(*a*), (*b*) and (*c*) illustrate an optional accessory.
Figure 24:
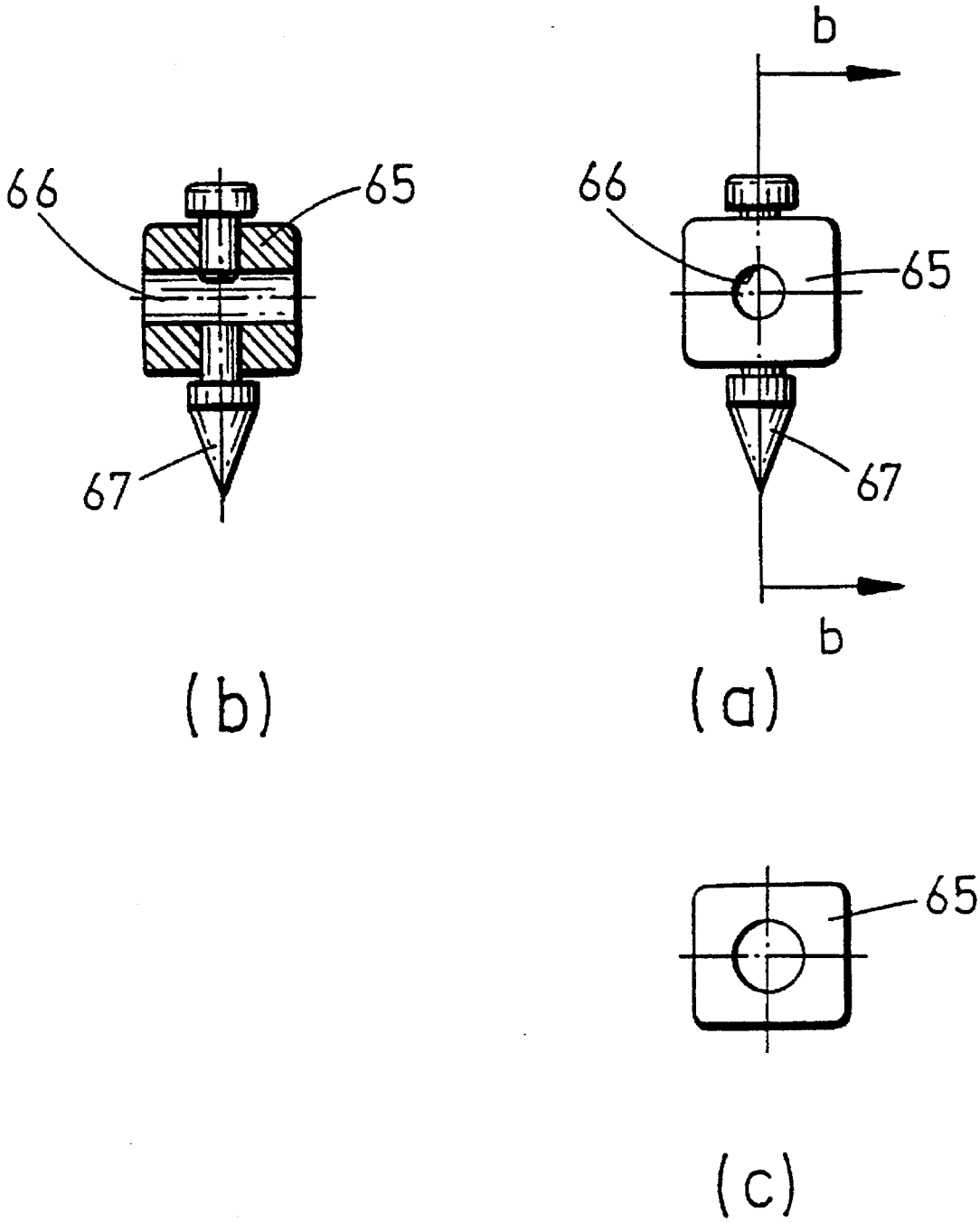
FIGS. 24(*a*), (*b*) and (*c*) illustrate another optional accessory.

FIGS. 22 to 24 illustrate optional, useful complements to the embodiment illustrated, or to any other embodiment of the invention. An accessory support, in the embodiment illustrated in FIG. 22 a rod 60, may be connected in any convenient way to the scissors, e.g. by inserting it into a bore 61 of the base jaw of the grip assembly, and accessories may be mounted on said support. FIGS. 23(*a*), (*b*) and (*c*) illustrate, in side view, cross-section on plane b—b and plan view respectively, one such accessory, which comprises a body 62 adapted to be engaged with rod 60 through seat 63 and having a guide member 64 in the form a suitably shaped plate, which can be slid along the edge of the material to guide the scissors in a linear motion when in use.

FIGS. 24(*a*), (*b*) and (*c*) illustrate, in side view, cross-section on plane b—b and plan view respectively, another optional such accessory, comprising a body 65 adapted to be engaged with rod 60 through seat 66 and a pointed finger 67, which is adapted to function as a pivot to guide the scissors in a circular motion.

Many other such accessories can be devised by persons skilled in the art.

While an embodiment of the invention has been described for purposes of illustration, it will be evident that the invention can be carried into practice with a number of variations, modifications and adaptations. In particular, mechanical equivalents can be devised for most of the components of the device. The structure of the grip assembly can be varied, as long as it is composed of two elements which are pivoted to one another and can be rotated one towards the other by squeezing action and return to their previous position by elastic means. Likewise, the blade assembly could have an entirely different structure, as long as it comprises two blades that are pivotally connected and can be relatively moved to exercise a cutting action or to return to their inoperative position, by actuating in turn the grip assembly. Those actuating means might be different from the lever arrangement indicated in the drawing and may comprise different adjusting means, to vary the ratio of the force exacted by the user and that exerted by one blade on the other, or might lack these adjusting means altogether. Likewise, the removable connection of the blade assembly to the grip assembly could be different from that illustrated, and a variety of such connections can be easily devised by persons skilled in the art, including permanent connections which will not permit to separate the two assemblies.

I claim:

1. Scissors, characterized in that they comprise a blade assembly comprising a base blade and a movable blade pivoted on said base blade, a grip assembly, spaced from said cutting assembly, comprising a base jaw and a pressure jaw, and a kinematic connection between said two assemblies, wherein said blade assembly is actuated for cutting action by applying pressure to said drip assembly, said movable blade being operatively connected to said pressure jaw by rocker lever means, said rocker lever means having at least two possible fulcrums and means being provided to select any one of them, selectively to permit changing the ratio between the pressure exerted by the use of the grip assembly and the shearing force exerted by the blades on the material being cut, said base blade comprising a cutting portion and a bracket extending at approximately right angles thereto, means being provided for connecting said bracket to said base jaw, whereby to assemble the scissors.

2. Scissors, characterized in that they comprise a blade assembly comprising a base blade and a movable blade pivoted on said base blade, a grip assembly, spaced from said cutting assembly, comprising a base jaw and a pressure jaw, and a kinematic connection between said two assemblies, wherein said blade assembly is actuated for cutting action by applying pressure to said grip assembly, said movable blade being operatively connected to said pressure jaw by rocker lever means, said rocker lever means having at least two possible fulcrums and means being provided to select any one of them, selectively to permit changing the ratio between the pressure exerted by the use of the grip assembly and the shearing force exerted by the blades on the material being cut, said rocker lever means operatively connecting said movable blade to said pressure jaw being provided with a follower which bears on a surface of said pressure jaw and with a follower which bears on the surface of said movable blade, said rocker lever being pivoted to said base jaw.

3. Scissors according to claim 2, further comprising means for guiding the scissors in parallel motion to the edge of the material or to a guiding line provided.

4. Scissors according to claim 2, further comprising means for guiding the scissors in a circular motion.

* * * * *